United States Patent [19]

Gammon et al.

[11] 4,371,151

[45] Feb. 1, 1983

[54] BLAST FURNACE SMELTING OF ZINC

[75] Inventors: Michael W. Gammon, Bristol; John A. Clarke, Thornbury; both of England

[73] Assignees: Metallurgical Process Limited; I.S.C. Smelting Limited, both of Nassau, The Bahamas

[21] Appl. No.: 929,977

[22] Filed: Aug. 1, 1978

[30] Foreign Application Priority Data

Sep. 15, 1977 [GB] United Kingdom ..... 38512/77

[51] Int. Cl.[3] ..... F27B 1/16

[52] U.S. Cl. ..... 266/186; 266/189; 266/197; 266/265; 266/270; 75/88

[58] Field of Search ..... 266/197-199, 266/265-270, 186-189; 75/41, 42, 86, 87, 88

[56] References Cited

U.S. PATENT DOCUMENTS

| | | | |
|---|---|---|---|
| 1,298,761 | 4/1919 | Miller | 266/189 |
| 1,789,870 | 1/1931 | Holzworth | 266/270 |
| 1,969,693 | 8/1934 | Fox et al. | 266/189 |
| 2,124,437 | 7/1938 | Steinbacher | 75/41 |
| 3,610,183 | 10/1971 | Kolboy et al. | 266/265 |

FOREIGN PATENT DOCUMENTS

| | | | |
|---|---|---|---|
| 2521096 | 11/1975 | Fed. Rep. of Germany | 266/197 |
| 1458869 | 12/1976 | United Kingdom . | |

*Primary Examiner*—M. J. Andrews
*Attorney, Agent, or Firm*—Holman & Stern

[57] ABSTRACT

A tuyere for a blast furnace, the main body of the tuyere being in the form of a tube with a central bore and the nose portion of the tuyere having a downwardly-inclined hood-like extension of the upper wall of the tube, whereby gas passing through the nose of the tuyere is deflected downwardly by the said extension, which extension has a gas outlet aperture of greater area than the cross-sectional area of the bore of the tube.

8 Claims, 1 Drawing Figure

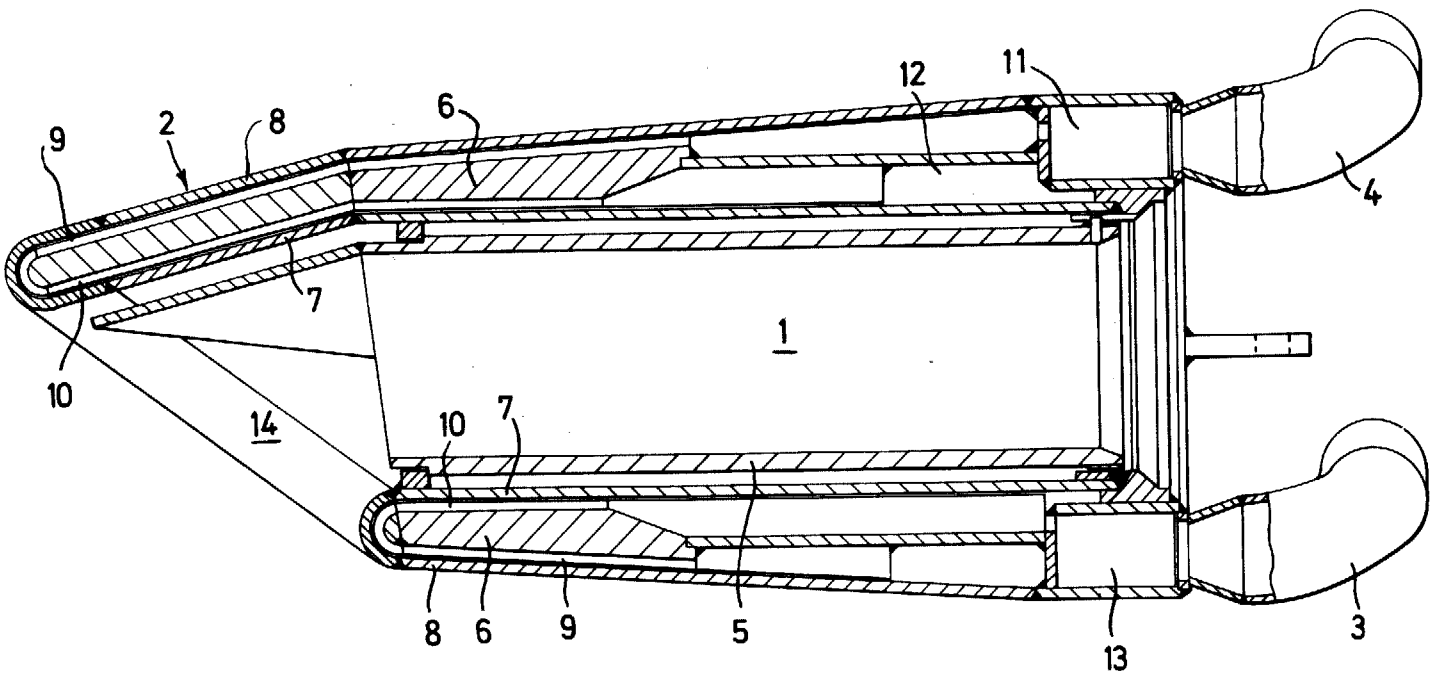
4
3
11
12
13
1
5
6
9
7
10
8
6
7
8
14
2
9
10

BLAST FURNACE SMELTING OF ZINC

BACKGROUND OF THE INVENTION

This invention relates to the blast furnace smelting of zinc, and more particularly to the introduction of a blast of air into such a furnace.

The smelting of zinc in a blast furnace is now a well known industrial technique, having been practised on a production scale since the early 1950's (see, for example, "Application of the Blast Furnace to Zinc Smelting" by Morgan and Woods, published in Metallurgical Reviews 1971, 16 (156), November, pages 161–174). In the process air, or oxygen-enriched air, is introduced through tuyeres near the furnace bottom and a zinc vapour-bearing gas is taken off through an offtake near the top of the shaft and zinc is condensed from this gas by means of a condenser which is irrigated with a spray of molten lead droplets.

One problem associated with the blast furnace smelting of zinc is the loss of zinc (as zinc oxide) in the slag falling to the furnace bottom. This slag may contain as much as 10% zinc as zinc oxide and this clearly represents an overall reduction in the recovery of zinc from the oxidic material fed to the furnace. Various attempts have been made to reduce the "zinc-in-slag" loss but the solubility of zinc oxide in the other slag-forming constituents and a requirement for the best possible fuel economy have made this difficult. It has been proposed to recover zinc from lead blast furnace slag by a "slag-fuming" process in which air and reducing material are blown into molten slag and the zinc fumed-off and oxidised, but this is not very acceptable for zinc blast furnace slags since it would require capital expenditure on additional plant and would be expensive in terms of fuel consumption.

British Pat. No. 1,458,869 describes one way of reducing zinc loss in slag, by blasting air into the slag pool through tuyeres downwardly-inclined at an angle of between 12° and 20° to the horizontal. This does provide some reduction in the zinc content of the slag but still better gas/slag contact is desirable. It is believed that in order to maximize the reduction of the zinc in the slag at the furnace bottom it is necessary to obtain the best possible contact between carbon monoxide-containing gas and a highly-dispersed molten slag phase. Thus two things are desirable:

1. Maximum dispersion of molten slag by the air blast, and

2. Slag droplets driven up into the furnace charge from where they fall, by gravity, counter-current to a rising gas stream containing carbon monoxide.

The carbon monoxide is generated by reaction of oxygen in the air blast with carbon, either in slag or in coke lumps, at the furnace bottom, or by the reaction of carbon dioxide with carbon.

We have now discovered that the physical contact between slag and gas can be increased by the employment of a specially-designed tuyere according to the present invention.

SUMMARY OF THE INVENTION

In one aspect, the present invention provides a tuyere for a blast furnace, the main body of the tuyere being in the form of a tube with a central bore and the nose portion of the tuyere having a downwardly-inclined hood-like extension of the upper wall of the tube, whereby gas passing through the nose of the tuyere is deflected downwardly by the said extension, which extension has a gas outlet aperture of greater area than the cross-sectional area of the bore of the tube.

By "cross-sectional area of the bore of the tube" is meant the area produced by cutting the tubular portion of the tuyere in a plane which is at right-angles to the longitudinal axis of the tubular part of the tuyere.

The extension may be either straight or curved in its longitudinal direction.

Where the extension is substantially straight in its longitudinal direction the angle between the longitudinal axis of the tubular portion of the tuyere and the wall of the extension is preferably within the range of from 12° to 20°, the preferred angle being 15° or 16°. Angles higher than 20° seem to give too high a gas resistance (pressure drop) and make cleaning of the tuyere by internal "rodding" difficult. It is to be understood that the main (tubular) body of the tuyere may itself be downwardly-inclined at an angle of between 12° and 20° to the horizontal as disclosed in British Pat. No. 1,458,869. Thus the overall downward inclination of the extension portion may be as high as 30° or more to the horizontal.

The tuyere may be manufactured by welding a precast hood-like extension portion onto the end of a tubular section.

It will be understood that references herein to the "wall" of the tuyere indicate a hollow wall containing passages for the circulation of a cooling fluid, usually water. This applies to both the tubular and extension parts of the tuyere. In practice, the tuyere will be manufactured with an annular space between the inner and outer walls and into this space baffles will be fitted to define cooling water passages between the baffles and the walls.

In a preferred arrangement, water is caused to flow in a generally longitudinal direction through the nose portion of the tuyere, through passages defined by inner and outer walls and a baffle inserted into the hollow space between the inner and outer walls. The water flow system may be a "multi-pass" system in which inflowing cooling water is passed through the nose over a first segment, say one-third, of the tuyere circumference and the same water is then caused to flow through the nose over at least a second segment of the circumference, preferably finally through the nose over a final, i.e. third, segment before exiting from the tuyere. The tuyere circumference is preferably divided into three segments by partition walls.

It is believed that the extension portion of the tuyere causes deflection of the gas passing through the tuyere nose, resulting in turbulence and hence greater ability to disperse slag upon impingement on the slag pool.

The invention in another aspect provides a zinc-smelting blast furnace having installed therein at least one tuyere according to the invention, the longitudinal axis of the tubular portion of the tuyere being downwardly-inclined at an angle between 12° and 20° to the horizontal.

In method of smelting zinc in a blast furnace, blast air is introduced into the furnace through at least one tuyere having a tubular main body with a downwardly-inclined hood-like extension of its upper wall, the air emerging through an aperture of greater area than the cross-sectional area of the tube.

The use of downwardly-inclined tuyeres and those with downwardly-inclined extensions is known in the blast-furnace art. Also tuyeres with constrictions at the nose end have been proposed. However, we believe it has not been previously proposed to provide a tuyere for a blast furnace having a downwardly-inclined hood-like extension of its upper wall and a gas outlet aperture of greater cross-sectional area than the bore of the tubular portion of the tuyere.

Amongst the advantages which accrue from the tuyere design according to this invention compared with other bent-nosed tuyeres are:

(a) reduced pressure drop (b) ease of rodding to clear obstructions (c) ease of removal from the furnace and (d) improved slag/gas interaction.

BRIEF DESCRIPTION OF THE DRAWING

The invention will be further described, by way of example only, with reference to the accompanying drawing, which is a diagrammatic longitudinal section through a blast furnace tuyere according to the invention.

DETAILED DESCRIPTION OF THE PREFERRED EMBODIMENT

The tuyere shown in the drawing has a main tubular section with a central bore 1 and a hood-like extension 2 of the upper wall. Inlet and outlet tubes for cooling water are designated by reference numerals 3 and 4 respectively. A blast tube 5 is provided within the central bore of the tuyere. A baffle 6 is inserted within the hollow annular space between inner and outer walls 7 and 8 respectively in the nose portion of the tuyere so as to define passages 9 and 10 for directing cooling water through the nose.

Cooling water entering through the tube 3 is directed through a chamber 13 and along the inner surface of the inner wall of the tuyere and hence through passages 10 and 9 to flow along the inner surface of the outer wall. This water flow is operative over a first third of the circumference of the tuyere. The water flowing out of this first segment passes through a partition wall into a second segment of the circumference where the flow pattern is repeated. Finally water from this second segment passes into a third segment of the circumference at 12 and the flow pattern is repeated again, water passed through the tuyere ending up in a chamber 11 and exiting via the outlet tube 4.

The outlet aperture 14 of the tuyere is of greater cross-sectional area than the bore 1 of the tubular portion of the tuyere. Thus air blown down the tubular portion of the blast tube 5 is both deflected downwardly and expanded as it emerges through the outlet aperture 14.

We claim:

1. A tuyere for a blast furnace, the tuyere comprising a main body in the form of a tube with a central bore of substantially constant cross-section, and a nose portion having a hood-like extension of the upper wall only of the tube, said extension being downwardly inclined with respect to the longitudinal axis of said main body when the tuyere is installed in a furnace, whereby gas passing through the nose of the tuyere is deflected downwardly by said extension, which extension has a gas outlet aperture of greater area than said constant cross-sectional area of the bore of the tube.

2. The tuyere according to claim 1, wherein said extension is substantially straight in its longitudinal direction and wherein the angle between the extension wall and the longitudinal axis of the tubular portion of the tuyere is within the range of from 12° to 20°.

3. The tuyere according to claim 2, wherein the angle between the extension wall and the longitudinal axis of the tubular portion is 15° to 16°.

4. The tuyere according to claim 1, wherein the tuyere wall is hollow and has inner and outer walls, the tuyere further comprising baffles inserted into the annular space between said inner and outer walls of the tuyere to define passages to carry a cooling fluid.

5. The tuyere according to claim 4, wherein the fluid conveying passages extend in a generally longitudinal direction through the nose portion of the tuyere.

6. The tuyere according to claim 5, wherein the fluid conveying passages constitute a multi-pass system in which inflowing cooling fluid is caused to pass through the nose over a first segment of the tuyere circumference and then to pass through the nose over at least one further segment of the tuyere circumference.

7. The tuyere according to claim 6, further comprising partition walls dividing the tuyere circumference into three said segments.

8. A zinc-smelting blast furnace having installed therein at least one tuyere the main body of which is in the form of a tube with a central bore, the nose portion of the tuyere having a downwardly-inclined hood-like extension of the upper wall of the tube, whereby gas passing through the nose of the tuyere is deflected downwardly by said extension, which extension has a gas outlet aperture of greater area than the cross-sectional area of the bore of the tube, and the longitudinal axis of the tubular portion of the tuyere being downwardly-inclined at an angle between 12° and 20° to the horizontal.

* * * * *